US005304760A

United States Patent [19]

Pham et al.

[11] Patent Number: 5,304,760

[45] Date of Patent: Apr. 19, 1994

[54] ULTRA-HIGH-TENSION CIRCUIT-BREAKER

[75] Inventors: Van Doan Pham; Joseph Martin, both of Meyzieu, France

[73] Assignee: GEC Alsthom SA, Paris, France

[21] Appl. No.: 954,030

[22] Filed: Sep. 30, 1992

[30] Foreign Application Priority Data

Oct. 2, 1991 [FR] France ..... 91 12118

[51] Int. Cl.[5] ..... H01H 33/16

[52] U.S. Cl. ..... 200/144 AP; 200/145

[58] Field of Search ..... 200/144 R, 144 A, 144 AP, 200/148 R, 148 A, 145

[56] References Cited

U.S. PATENT DOCUMENTS

| | | | |
|---|---|---|---|
| 4,421,962 | 12/1983 | Thuries et al. | 200/144 AP |
| 4,439,651 | 3/1984 | Thuries et al. | 200/144 AP |
| 5,124,872 | 6/1992 | Pham et al. | 361/11 |
| 5,164,559 | 11/1992 | Pham et al. | 200/144 AP |
| 5,170,023 | 12/1992 | Pham et al. | 200/144 AP |

FOREIGN PATENT DOCUMENTS

| | | |
|---|---|---|
| 0430123 | 6/1991 | European Pat. Off. . |
| 0431306 | 6/1991 | European Pat. Off. . |
| 0444568 | 9/1991 | European Pat. Off. . |
| 2503448 | 10/1982 | France . |
| 2512267 | 3/1983 | France . |

*Primary Examiner*—J. R. Scott

*Attorney, Agent, or Firm*—Sughrue, Mion, Zinn, Macpeak & Seas

[57] ABSTRACT

The present invention relates to an ultra-high-tension interrupting chamber comprising a main chamber including an insulating case containing permanent contacts, arcing contacts and two closing resistors inserted by means of semi-moving "make switch" device putting a "first" one of the resistors into operation before the "second" resistor. An auxiliary chamber is connected in parallel with the main chamber, which auxiliary chamber includes an insulating casing containing an opening varistor associated with a break switch having a slow-release opening mechanism situated inside the casing.

6 Claims, 3 Drawing Sheets

ULTRA-HIGH-TENSION CIRCUIT-BREAKER

The present invention relates to an ultra-high-tension circuit-breaker, and more precisely to an ultra-high-tension interrupting chamber comprising a main chamber including an insulating case containing permanent contacts, arcing contacts and two closing resistors inserted by means of a semi-moving "make" switch device putting a "first" one of the resistors into operation before the "second" resistor.

BACKGROUND OF THE INVENTION

It is known that operating voltage surges in atmospheric air are not proportional to the degree of isolation. This is why, at ultra high tension (voltage of not less than 1,000 kV, referred to below as UHT), extremely low operating voltage surges are required for circuit-breakers, e.g. 1.6 pu instead of 3 pu which is acceptable at 245 kV.

The January 1989 edition of the CIGRE review Electra (No. 122, pages 43 and 44) states that UHT circuit-breakers are to be equipped with closing resistors and with opening resistors.

French "Certificate of Addition" No. 2,503,448 (U.S. Pat. No. 4,421,962 ) filed on Mar. 31, 1981 by the Applicant describes a compressed-gas high-tension circuit breaker including two closing resistors whose insertion devices are secured to each other, the insertion device of the first resistor comprising a tubular semi-moving contact that co-operates with a contact connected to the second resistor which is constituted by a stack of annular resistors disposed coaxially about the first resistor.

French Patent Application No. 2,658,949 filed on Feb. 27, 1990 by the Applicant discloses a high-tension circuit-breaker assisted by a varistor disposed in an "auxiliary" chamber which is distinct from the interrupting chamber, and which is connected in series with a break switch comprising a moving contact in the form of a metal rod fixed to a flexible metal cable interconnecting the two chambers via a slow-release opening device situated outside the chambers and actuated by the control rod of the interrupting chamber.

An object of the present invention is to combine, inter alia, those two known techniques so as to provide a UHT circuit-breaker which satisfies the voltage-surge requirements and which is also compact in construction.

SUMMARY OF THE INVENTION

To this end, an auxiliary chamber is connected in parallel with the main chamber, which auxiliary chamber includes an insulating casing containing an opening varistor associated with a break switch having a slow-release opening mechanism situated inside the casing of the auxiliary chamber.

By using a varistor instead of a resistor, it is possible to reduce voltage surges more effectively, and to avoid having to use compressed gas arc-blasting in the break switch. Because of its resistance that varies with a high coefficient of non-linearity, the varistor (e.g. zinc oxide) adapts better to the circuit so as to reduce the voltage surges. The residual current is interrupted automatically without blasting when the voltage drops to near zero.

Since the slow-release mechanism is disposed inside the casing of the auxiliary chamber, it is possible to protect it from external events such as rain, wind, or hail.

In a preferred embodiment, the switch is actuated by a flexible metal cable connected directly to the drive rod of the main chamber.

In this way, a single control device that is particularly simple and reliable is provided both for the main chamber and for the auxiliary chamber.

Advantageously, the slow-release opening mechanism of the break switch operates by inertia.

In this way, no specific separate slow release device needs to be mounted in the chambers.

Preferably, the varistor is constituted by a stack of varistors in the form of cylindrical pellets disposed inside an insulating tube.

In a specific embodiment, the switch comprises a fixed metal support tube in which another metal tube is mounted to slide longitudinally, which other metal tube is electrically connected to the support tube and is connected via its bottom end to the end of the flexible cable, with an insulating washer closing the top end of said other tube and a metal rod passing through said top end, which metal rod is electrically connected to said other tube, and the top portion of the metal rod supports a contact sleeve that is-engagable with contact fingers mounted at the bottom end of the varistor, the bottom portion of the rod being provided with a conical abutment designed to engage with a complementary conical shoulder inside said other tube, a spring being disposed inside said other tube and around the rod between the top end of the tube and the bottom end of the rod, the spring being slack when the switch is at rest in the engaged position or in the disengaged position.

Preferably, the abutment secured to the bottom portion of the rod is made of polytetrafluoroethylene.

The invention also provides an $SF_6$ multi-interruption ultra-high-tension circuit-breaker, including both main and auxiliary interrupting chambers which are connected together in series, which are disposed vertically in columns, and which are equipped with distribution capacitors, with one main interrupting chamber per support column, the interrupting chambers of the circuit-breaker being interrupting chambers as described above.

BRIEF DESCRIPTION OF THE DRAWINGS

An embodiment of the invention is described by way of example with reference to the accompanying drawings, in which:

FIG. 1 shows the main interrupting chamber 1, the auxiliary chamber 2, and part of the support column 3.

DETAILED DESCRIPTION

Figure 1:
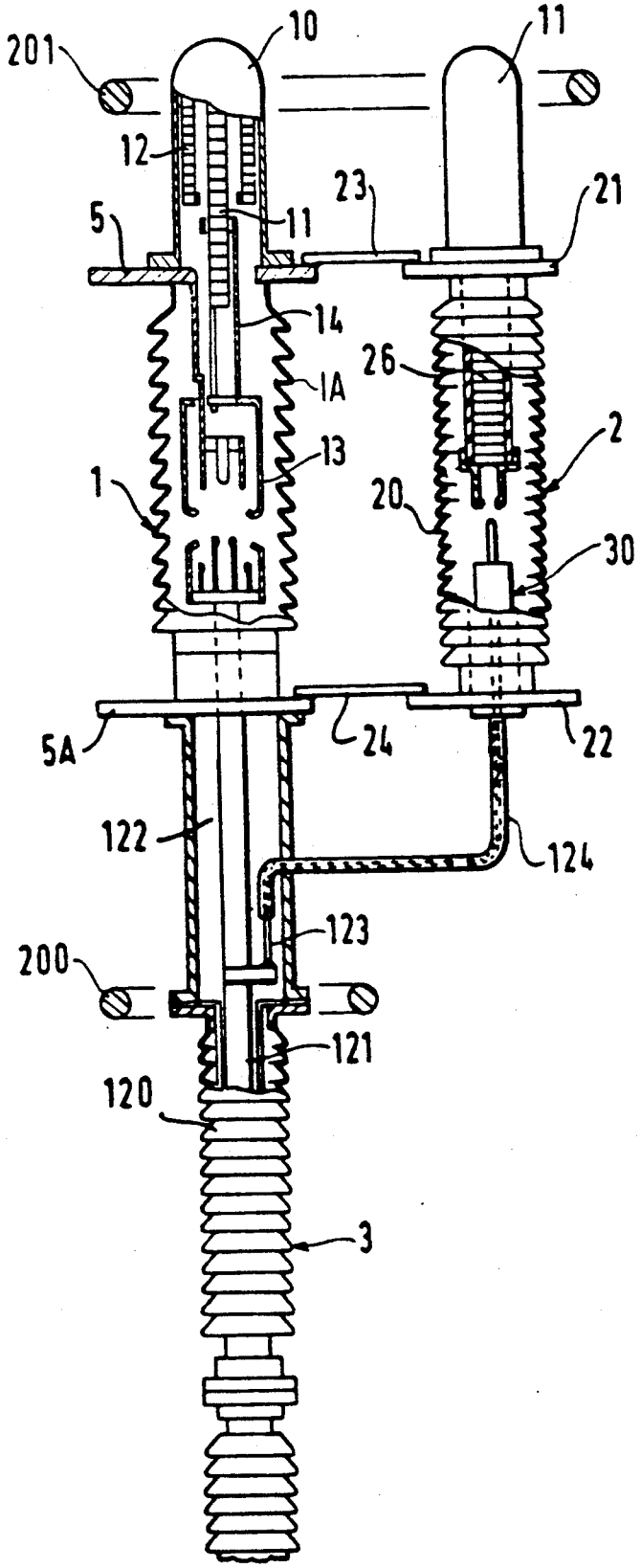
FIG. 1 is an elevation view partially in section of an interrupting chamber of the invention.

The main chamber 1 is an interrupting chamber of the type described in French "Certificate of Addition" No. 2,503,448 (U.S. Pat. No. 4,421,962. It comprises an insulating casing 1A, e.g. made of a ceramic, which casing includes a top plate 5 at its top end, the top plate being connected to a first terminal. A cover 10 extends the top of the casing and houses two closing resistors, the first of which is formed by a stack of cylindrical resistive pellets 11, e.g. based on carbon, and the second of which is formed by a stack of annular resistors 12 disposed concentrically about the first resistor. A semi-moving "make-switch" insertion device includes a tubular first-resistor insertion contact 13 at its bottom end, and a tubular second-resistor insertion contact 14 at its top end. A second terminal is connected to the bottom plate 5A.

An auxiliary chamber 2 is connected in parallel with the main chamber 1, the plates 5 and 5A of the main chamber 1 being connected to the plates 21 and 22 of the auxiliary chamber 2 respectively via a conductor 23 and via a conductive support plate 24. The chamber 2 comprises an insulating casing 20, e.g. made of porcelain, which casing houses an opening varistor 26 associated with a break switch 30 shown diagrammatically in FIG. 1. A cover 11 extends the casing 20 so as to house the varistor 26 which is constituted by a stack of cylindrical-pellet shaped varistors based on zinc oxide and disposed inside an insulating tube in a manner known per se.

The break switch 30 is actuated by a mechanism connected directly to the drive rod 121 of the main chamber 1. The drive rod is housed in an insulating column 120 supporting the main chamber 1. The drive rod 121 is extended by a metal portion 122 connected to the conventional moving equipment of the main chamber 1. The drive rod is also connected to a flexible metal cable 123 fixed to the break switch 30, and the flexible cable 123 is placed inside a rigid metal sheath 124.

Rings 200 and 201 are disposed above and below the chambers 1 and 2 so as to reduce visible discharge (Corona effect), and so as to improve the dielectric strength both of the interrupting chamber and of the supporting insulator.

Preferably, resistive carbon-based pellets are connected in series with the varistor disks 26 so as to limit the residual current to a certain value, when interrupting high re-established voltage.

Figure 2:
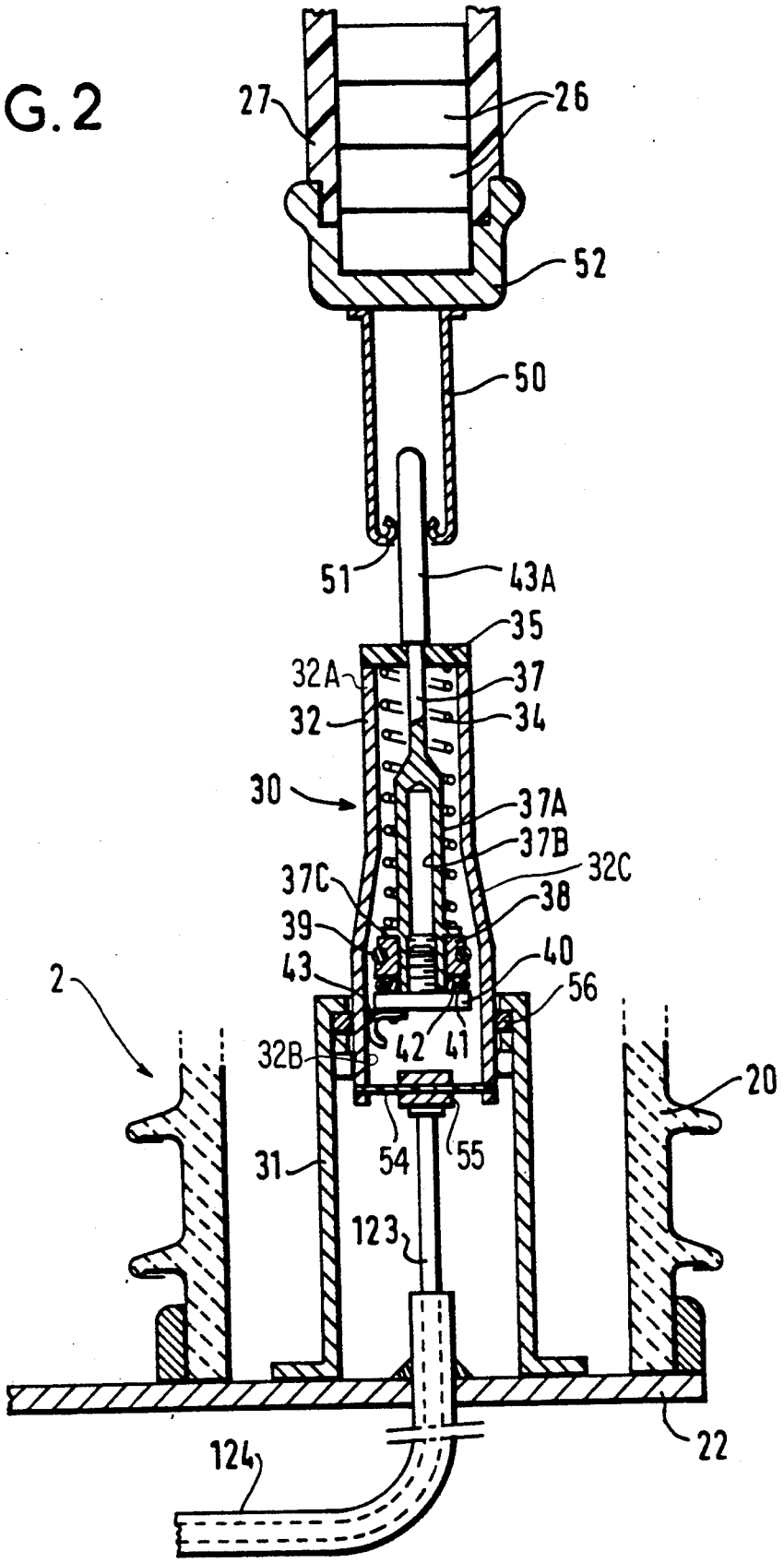
FIG. 2 is a section through a detail of the insertion device of the auxiliary chamber.

FIG. 2 shows the break switch 30 of the auxiliary chamber 2 in more detail.

The break switch is mounted on the bottom plate 22 of the auxiliary chamber 2, and the flexible cable 123 inside its sheath 124 passes through said bottom plate. To be more precise, a metal support tube 31 is fixed to the bottom plate 22, and another metal tube 32 is mounted to slide longitudinally in the support tube 31. At its bottom end, the other metal tube 32 has a diametral insulating strip 54 to which the end of the flexible cable 123 is fixed via a washer 55. A sliding electrical contact 56 interconnects the two tubes 31 and 32.

The top end 32A of tube 32 is closed by an insulating washer 35. A rod 37, e.g. made of high-strength brass, is disposed inside tube 32. A top portion of the rod 37 passes through the washer 35 and supports a contact sleeve 43A which is preferably screwed to the rod 37 and made of copper.

The diameter of the bottom portion 37A of the rod 37 is larger than the diameter of the central portion of the rod 37, and the bottom portion 37A has a tapped bore 37B in its bottom end. Close to the bottom end of the bottom portion 37A, a shoulder 37C serves as an abutment for a ring 38 which is conical in outside shape, which is preferably made of polytetrafluoroethylene, and which is equipped with an annular ring 39. The conical ring 38 is held in place by the head of a bolt 40 screwed into the bore 37B, with seals 41 and 42 being interposed. The head of the bolt 40 is electrically connected to tube 32 at a bottom end 32B via at least one contact finger 43. A metal coil spring 34 is disposed between the shoulder 37C and the washer 35.

Tube 32 has an inside flared conical shoulder 32C designed to receive the conical ring 38 which bears thereagainst.

A metal closing piece 52 is mounted at the bottom end of the stack of varistors 26 housed inside the insulating tube 27, which closing piece retains the varistors 26 and is fixed to a metal tube 50 terminated by contact fingers 51 designed to engage the sleeve 43A.

The break switch 30 operates as follows:

in the closed position (FIG. 2), the contact sleeve 43A is in contact with the fingers 51, the varistor is inserted, in series and the spring 34 is slack; and when the switch 30 opens, the sliding tube 32 is pulled downwards by the flexible cable 123, thereby compressing the spring 34; because of inertia, the rod 37 and the sleeve 43A remain stationary, so the varistor remains inserted. Due to this "slow-release" construction; once the spring 34 is fully compressed, with conical ring 38 abutting the sliding tube 32 conical shoulder 32C the rod 37 is driven smoothly downwards by means of the conical shoulder in the tube 32 that engages with the conical ring 38 and the annular ring 39 thereon; the sleeve 43A and the fingers 51 separate from each other, and the varistor 26 is withdrawn from the circuit.

The insertion time and the withdrawal time of the varistor 26 are adjusted by dimensioning the components of switch 30. One parameter is particularly important, namely the length of the rod 37 that is under the sleeve 43A and that projects from the washer 35 when the spring 34 is fully compressed, which length corresponds to the stroke of tube 32 before it drives the rod 37 on opening.

Figure 3:
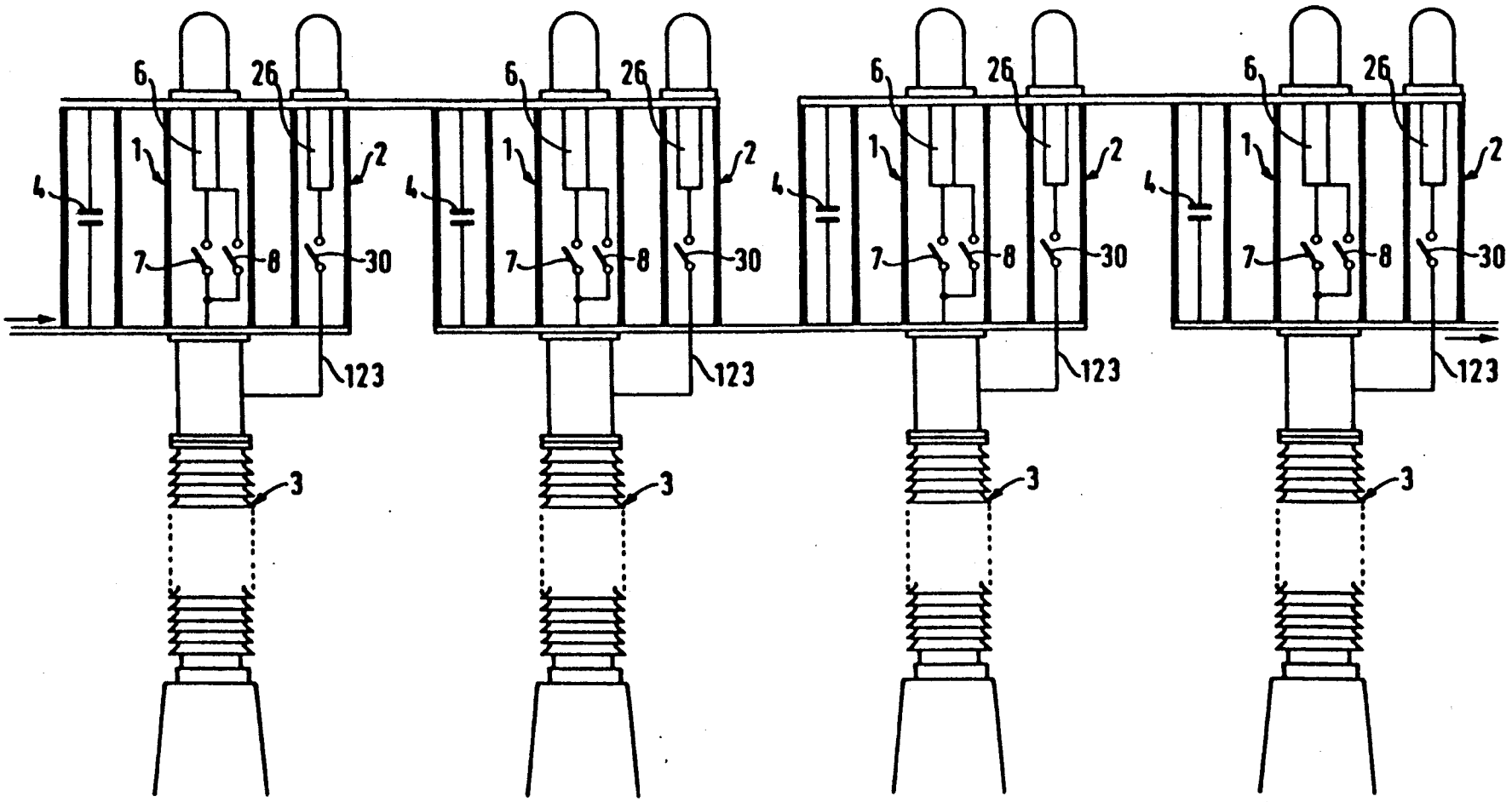
FIG. 3 shows one phase of a UHT circuit-breaker equipped with such interrupting chambers.

FIG. 3 is a diagrammatic view showing one phase of an $SF_6$ multi-interruption UHT circuit-breaker, and more precisely of a 1,150 kV circuit-breaker including four main chambers. For a voltage of 1,500 kV, it would comprise five chambers in series. The main chambers are disposed vertically and in columns, with one chamber per support column, and this improves the mechanical strength of the chambers.

Each chamber is as described above, with each main chamber 1 containing the closing resistors 6, the interrupting contacts 7, and the insertion "make" switch 8 for inserting the resistors 6, and each auxiliary chamber 2 containing the opening varistor 26 and the break switch 30 having a slow-release mechanism. Distribution capacitors 4 are conventionally mounted at the terminals of the chambers.

Such a circuit-breaker operates as follows:

on closing;

the make switch 8 is closed to begin with, and it inserts the first closing resistor into the circuit about 10 ms before the arcing contacts 7 in the main chamber come into contact with each other; about 5 ms before the arcing contacts 7 come into contact with each other, the second closing resistor is inserted, and, at the same time, the break switch 30 closes, thereby putting the varistor 26 into the circuit; arcing-contact 7 closing then short-circuits both the closing resistors 6 and the opening varistor 26; and on opening:

by means of the slow-release mechanism of the switch 8, the closing resistors 6 are not inserted into the circuit when the arcing contacts separate; the permanent contacts separate first followed by the arcing contacts 7; about 10 ms after the arcing contacts 7 in the main chamber 1 have separated, the contacts in the break switch 30 separate and interrupt the residual current passing through the varistor 26.

We claim:

1. In an ultra-high-tension interrupting chamber including a main interrupting chamber comprising a first plate connected to a first terminal, a second plate connected to a second terminal and an insulating case between said plates and containing permanent contacts, arcing contacts and two closing resistors and a make switch device operatively coupled to said two resistors and having means for inserting one of said two resistors into operation before a second of said two resistors, the improvement comprising an auxiliary chamber connected in parallel with the main interrupting chamber and mechanically to said first and second plates, said auxiliary chamber including an insulating casing containing an opening varistor and a break switch connected to one of said plates and having a slow-release opening mechanism situated inside the casing of the auxiliary chamber and operatively connected to said opening varistor.

2. An interrupting chamber according to claim 1, wherein the break switch is actuated by a flexible metal cable connected directly to the drive rod of the main chamber.

3. An interrupting chamber according to claim 1, wherein the varistor is constituted by a stack of varistors in the form of cylindrical pellets disposed inside an insulating tube.

4. An interrupting chamber according to claim 1, wherein the break switch comprises a fixed metal support tube, another metal tube is mounted in said fixed metal support tube for sliding longitudinally within said fixed metal support tube, said another metal tube being electrically connected to the support tube and being connected via a bottom end thereof to an end of the flexible cable, an insulating washer closing a top end of said another tube, a metal rod being mounted within said another tube and having and thereof passing through said top end, said metal rod being electrically connected to said another tube, and a top portion of the metal rod supporting a contact sleeve engagable with contact fingers mounted at a bottom end of the varistor and being electrically connected to said contact fingers, a bottom portion of said rod being provided with a conical abutment engagable with a complementary conical shoulder of said another tube, a spring being disposed inside said other tube and around the rod between the top end of the tube and the bottom end of the rod, and said spring being slack when the switch is at rest in the engaged position or in the disengaged position whereby, said rod and said contact sleeve of said rod and said contact fingers are maintained in engagement by inertia of said rod.

5. An interrupting chamber according to claim 4, wherein the abutment secured to the bottom portion of the rod is made of polytetrafluoroethylene.

6. An $SF_6$ multi-interruption ultra-high-tension circuit-breaker, including both main and auxiliary interrupting chambers which are connected together in series, which are disposed vertically in columns, and which are equipped with distribution capacitors, with one main interrupting chamber per support column, wherein the interrupting chambers are interrupting chambers according to claim 1.

* * * * *